US010370944B2

(12) United States Patent
McNelis et al.

(10) Patent No.: US 10,370,944 B2
(45) Date of Patent: Aug. 6, 2019

(54) PERFORATING GUN WITH A HOLDING SYSTEM FOR HOLLOW CHARGES FOR A PERFORATING GUN SYSTEM

(71) Applicant: DYNAENERGETICS GMBH & CO. KG, Troisdorf (DE)

(72) Inventors: Liam McNelis, Bonn (DE); Jörn Olaf Löhken, Troisdorf (DE); Louis Anthony Bernardi, Jr., Angleton, TX (US); Mark Shelley Brinsden, Bristol (GB)

(73) Assignee: DYNAENERGETICS GMBH & CO. KG, Troisdorf (DE)

( * ) Notice: Subject to any disclaimer, the term of this patent is extended or adjusted under 35 U.S.C. 154(b) by 17 days.

(21) Appl. No.: 14/434,331

(22) PCT Filed: Oct. 8, 2013

(86) PCT No.: PCT/EP2013/070912

§ 371 (c)(1),
(2) Date: Jun. 15, 2015

(87) PCT Pub. No.: WO2014/056890

PCT Pub. Date: Apr. 17, 2014

(65) Prior Publication Data

US 2015/0376991 A1 Dec. 31, 2015

(30) Foreign Application Priority Data

Oct. 8, 2012 (DE) ..... 10 2012 019 652

(51) Int. Cl.
*E21B 43/117* (2006.01)

(52) U.S. Cl.
CPC ..... *E21B 43/117* (2013.01)

(58) Field of Classification Search
CPC .... E21B 43/117; E21B 43/116; E21B 43/119; E21B 29/02; E21B 43/11852;
(Continued)

(56) References Cited

U.S. PATENT DOCUMENTS 2,696,169 A * 12/1954 Lassiter, Jr. ..... E21B 43/117 175/4.53
2,927,534 A * 3/1960 Le Bus ..... E21B 43/117 175/4.53

(Continued)

FOREIGN PATENT DOCUMENTS

WO WO 9946476 A1 9/1999
WO WO 2013032991 A2 7/2013

OTHER PUBLICATIONS

PCT/EP2013/070912 International Search Report and Written Opinion, dated Sep. 19, 2014.

(Continued)

*Primary Examiner* — Joshua E Freeman
*Assistant Examiner* — Bridget A Cochran
(74) *Attorney, Agent, or Firm* — Moyles IP, LLC

(57) ABSTRACT

A perforating gun of a perforating gun system is provided including hollow charges positioned within a holding device. The holding device includes holes in which the hollow charges are inserted and secured. In an embodiment, the holes are arranged on at least one helix. In a further embodiment, the perforating gun provides collapsible and fragmentable components that minimize debris remaining in a wellbore upon detonation of the charges.

20 Claims, 4 Drawing Sheets

(58) Field of Classification Search
CPC ..... E21B 43/263; E21B 43/12; E21B 49/04; F42B 1/02; F42B 1/028; F42B 3/24; F42B 12/76
USPC ..... 89/1.15
See application file for complete search history.

(56) References Cited

U.S. PATENT DOCUMENTS 4,253,523 A 3/1981 Ibsen
4,960,171 A * 10/1990 Parrott ..... E21B 43/117 166/297
5,477,785 A * 12/1995 Dieman, Jr. ..... E21B 43/116 102/313
5,785,130 A * 7/1998 Wesson ..... E21B 43/1185 102/310
5,829,538 A * 11/1998 Wesson ..... E21B 43/117 175/4.6
6,487,973 B1 * 12/2002 Gilbert, Jr. ..... E21B 43/117 102/312
7,762,351 B2 * 7/2010 Vidal ..... E21B 43/117 175/4.6
9,441,438 B2 * 9/2016 Allison ..... E21B 29/02
2005/0109501 A1 * 5/2005 Ludwig ..... E21B 43/117 166/55
2005/0211467 A1 * 9/2005 Ratanasirigulchia ..... E21B 43/117 175/4.5
2008/0264639 A1 * 10/2008 Parrott ..... E21B 17/05 166/297
2009/0183916 A1 * 7/2009 Pratt ..... E21B 43/117 175/2
2010/0276136 A1 * 11/2010 Evans ..... E21B 43/11 166/55.2
2013/0118805 A1 * 5/2013 Moody-Stuart ..... E21B 43/116 175/2
2015/0376991 A1 * 12/2015 McNelis ..... E21B 43/117 89/1.15
2016/0348484 A1 * 12/2016 Allison ..... E21B 29/02

OTHER PUBLICATIONS

Canadian Intellectual Property Office, Office Action of Canadian App. No. 2,886,310, which is in the same family as U.S. Appl. No. 14/434,331, dated Apr. 15, 2019, 3 pgs.
European Patent Office, Decision to Grant a European Patent of Application No. 13774155.9, which is in the same family as U.S. Appl. No. 14/434,331, dated Nov. 8, 2018, 2 pgs.
European Patent Office, Office Submission Response to Office Action of European Patent of Application No. 13774155.9, which is in the same family as U.S. Appl. No. 14/434,331, dated Jan. 23, 2018, 15 pgs.

* cited by examiner

PERFORATING GUN WITH A HOLDING SYSTEM FOR HOLLOW CHARGES FOR A PERFORATING GUN SYSTEM

CROSS-REFERENCE TO RELATED APPLICATIONS

This application claims priority to PCT Application No. PCT/EP2013/070912, filed Oct. 8, 2013, which claims priority to German Patent Application No. 102012019652.0, filed Oct. 8, 2012, each of which are incorporated herein by reference in their entirety.

FIELD

A perforating gun of a perforating gun system, is provided with hollow charges and with a holding device having holes in which the hollow charges are inserted and secured.

BACKGROUND

A perforating gun system denotes a system for hollow charges, holding devices for the hollow charges, connecting pieces of the holding device, as well as ballistic initiation and transmission mechanisms, e.g. the detonating cord for firing the hollow charges. The purpose of the perforating gun system is the perforation of pipes in boreholes using hollow charges. A perforating gun is to be understood as a holding device to which, amongst other things, the hollow charges are secured. The ballistic initiation and transmission mechanisms, which will not be described in greater detail here, are also installed in the perforating gun.

So-called Through Tubing Gun (TTG) systems exist in which encapsulated charges are connected with small connecting elements. These also remain in the borehole; such systems, however, are much more unstable. They are limited in length (about 12 m) or in towing capacity and are not stiff/rigid. They therefore cannot absorb any pressure load.

According to the state of the art, after the perforation or after the triggering of the hollow charges, the perforating gun is withdrawn from the borehole. This requires time and involves costs.

BRIEF DESCRIPTION

According to an embodiment, one object is improving a perforating gun of a perforating gun system in such a way that by detonation of hollow charges, a detonating cord or other explosive material, the perforating gun is broken down into the smallest of pieces or parts and can remain in the piping of the borehole after the perforation. The fragments resulting from the detonation of the hollow charges shall, due to their small size, form a deposit in the borehole. A total height of the fragmented debris, in an embodiment, amounts to a height as low as about 10%-20%, and in an embodiment amounts to a height as low as about 10%-15% of a predetonation length of the perforating gun. Typical embodiments form a deposit in the borehole, the total height of which is at most 20%, typically at most 15% of the predetonation length. A withdrawal of the perforating gun is therefore no longer necessary. Typically, the deposit values named herein refer to a borehole or piping of a borehole with an inner diameter which is at most 2 times or at most 1.5 times the outer diameter of the perforating gun, the outer diameter typically including the hollow charges.

Another object is achieved by each individual hollow charge being encapsulated hydraulically sealed, the holding device including at least one pipe or tube, on the circumferential surface of which the holes are arranged either on at least one helix or on multiple, parallel extending helices. In perforating guns according to the state of the art, the holding devices, upon which the hollow charges are secured, are coaxially enclosed by a pipe, whereby the hollow charges are sealed-off from external influences. Since according to an embodiment, each individual hollow charge is encapsulated and hydraulically sealed, a simple holding device without expensive separators, seals or the like will do as perforating gun. In this way, the hollow charges are positioned close to one another and require less space, which allows a higher number of charges per foot of the length of the gun/holding device than has previously been commercially available, in for instance, a normal capsulated gun system. The perforating gun according to an embodiment is therefore much lighter than those in the state of the art.

As a further feature, the material of the at least one pipe consists of stainless steel, or aluminium, or cast steel, or a plastic such as epoxy resin. During the detonation, these materials are broken down into small fragments. The wall thickness of the pipes must be chosen so that the holding device has the required stability but it must be so low that a breakdown is not prevented. A wall thickness of the pipe is typically between 2 and 8 mm, and in an embodiment between 3 mm and 5 mm has been shown to be sufficient. A key feature is the ability to be able to absorb pressure loads or loads of 1 to 2 tons. Typical embodiments are configured to carry more than 1.5 or more than 2 tons tensile load or more than 2.5 tons or more than 3 tons compression load in the longitudinal direction of the pipe. Typical embodiments are configured to carry themselves, typically plus at least 1 ton.

In an embodiment, each individual tube or pipe typically has a length between 1 m and 6 m. In an embodiment, individual pipes are connected to each other via a connecting element, for example a thread. The plurality of pipes are thus typically connected to one another at their end faces via the connecting element and the length of all pipes connected to one another is in an embodiment between 15 and 100 m, in a further embodiment between 30 and 80 m, and in yet a further embodiment is 50 m.

In an embodiment, the holes are arranged along one or more, and in an embodiment 3 to 6, in further embodiment 3 to 4, parallel extending helices. This is one of the favourable possibilities for arranging the hollow charges. The holding device is configured with holes arranged along the one or more helices. Per turn, between 2 to 8 holes are positioned per helix, or 3 to 8, or 2 to 6, or 2 to 4, or 3 to 4 holes. In an embodiment, all the holes have a diameter that corresponds to an outer diameter of the hollow charge.

For targeted weakening of the at least one pipe, recesses, grooves or additional holes without hollow charges are inserted to the pipe between the holes with the hollow charges.

In an embodiment, the connecting element is configured to be screwed, threaded, clipped, wedged, or welded together. Clipped is to be understood as a plug/bayonet connection.

In an embodiment, the centers of all holes (for the hollow charges) are arranged on planes (E1, E2, E3) which are perpendicular to the longitudinal axis L of the at least one pipe and extend parallel to each other, and both of the two adjacent planes are arranged at the same distance L1 from one another, and the same number of holes or their centers is arranged on all planes, and the centers of the holes on one plane E1 are offset from the centers of the holes on the adjacent planes E2 and E3 in order to increase the number of hollow charges or the charge density.

According to an aspect, the hollow charges are arranged such that there is an increased or high shot density, meaning that the number of charges per length of the perforating gun is high. Typical embodiments comprise at least 10 or typically at least 15 shots per feet or typically 15-18 shots per feet. The "shots per feet" are measured in a longitudinal direction of the perforating gun.

As shown in the figures, due to the selection of material used to manufacture the holder, and the size and arrangement of the holes positioned in the holder, the perforating gun in an embodiment is configured to accommodate many hollow charges such that detonation results in an increased number of perforations, while maintaining a length of as low as about 10-20% of the pre-detonation length (of the one or more guns strung together) in broken components remaining in the wellbore. Typical embodiments comprise hollow charges which are configured to withstand a hydraulic pressure of at least 15,000 psi, typically at least 18,000 psi or typically 20,000 psi.

In an embodiment, the charges are arranged on parallel extending helices. The helices begin in the same plane or in planes offset from one another and the starting points are each shifted by the same angle from one another. Per turn, 3-8 holes are arranged at the same angle and axial distance from one another.

The perforating gun according to an embodiment relates is characterized by a high stability and imperviousness to hydraulic pressure. It is also configured to withstand a compressional load along the longitudinal axis, which exceeds the weight of the system many times over. When suspended in the borehole, the perforating gun is able to carry its own weight while suspended. These properties are achieved by the use of encapsulated hydraulically sealed hollow charges, the material of which allows for being broken down into the smallest of pieces. The holding device for the hollow charges is a pipe of steel, plastic or the like with a pattern of holes. The holes are used for inserting the hollow charges, which are secured therein. The arrangement of the charges in a single, double, triple or multiple helix enables breaking the pipe up into the smallest of pieces or fragments as a result of the detonation. The required stability of the pipe to withstand compression and tension is achieved by the geometry of the pattern of holes (helix helices) and the thickness as well as the material of the pipe. Also, the diameter of the pipe exerts an influence on the stability.

The perforating gun may consist of one or more such pipes with hollow charges. The pipes are then, where appropriate, connected by connecting mechanisms, which also remain in the borehole after detonation. The use of ballistic transmission mechanisms between the segments allows for a joint ignition of all the explosive charges contained in the whole system by an initiation system. Transmission and initiation systems are also able to withstand the aforementioned hydraulic pressure.

Apart from the aforementioned materials and the wall thickness of the pipes, the arrangement of the holes for the hollow charges is important for the breakdown of the pipes.

If the pipes are divided into individual planes E, all of which extend parallel to one another and perpendicular to the longitudinal axis L of the pipes, then two adjacent planes will be arranged at the same distance L1 from one another, respectively. On these planes, the holes or the centers of the holes are arranged on the pipes. On all planes, the same numbers of holes are arranged on the pipes. Considering a first plane E1, the centers of the holes on adjacent planes E2 and E3 are each offset from the holes on the first plane in order to increase the number of hollow charges or the charge density.

A minimum of two and a maximum of five holes are arranged on one plane. In an embodiment, three holes are arranged on each plane. In the case of three holes on each plane, the distance between the holes is 120° with respect to the circumference of the pipe. In an embodiment, the holes on adjacent planes are offset by 60°.

In order to promote the breakdown of the pipes into small individual pieces, recesses, grooves or additional holes may be introduced in the pipe. These recesses, grooves or additional holes are located between the holes in which hollow charges are secured.

Helix is to be understood as a helical path or spiral that winds with a constant slope around the outer surface of a cylinder (pipe). Two parallel helices are to be understood as the second helix being offset from the first helix by half a turn. The two helices then have a constant spacing and never touch. This is analogous to multiple helical paths.

BRIEF DESCRIPTION OF THE FIGURES

A more particular description of the embodiments briefly described above will be rendered by reference to specific embodiments thereof that are illustrated in the appended drawings in which the described functions are technically carried out as follows.

DETAILED DESCRIPTION

Hereinafter, embodiments will be exemplified with reference to the Figures.

Figure 1A:
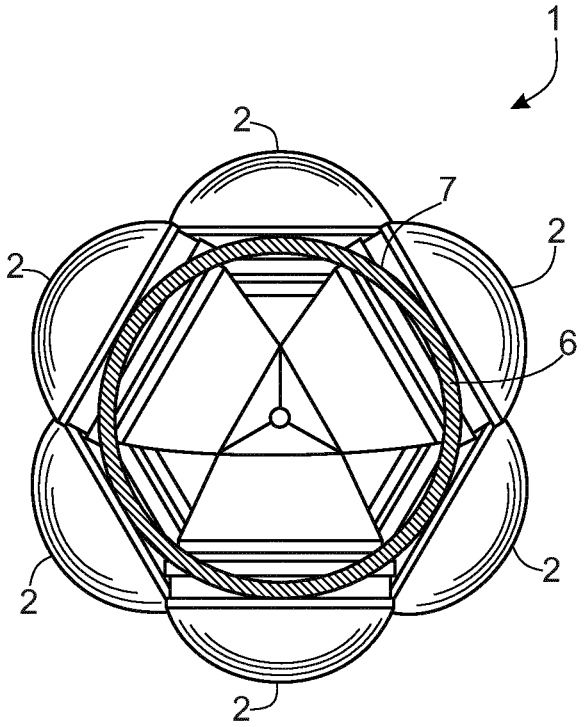
FIG. 1*a* depicts an end view of a holding device according to an embodiment.
Figure 1B:
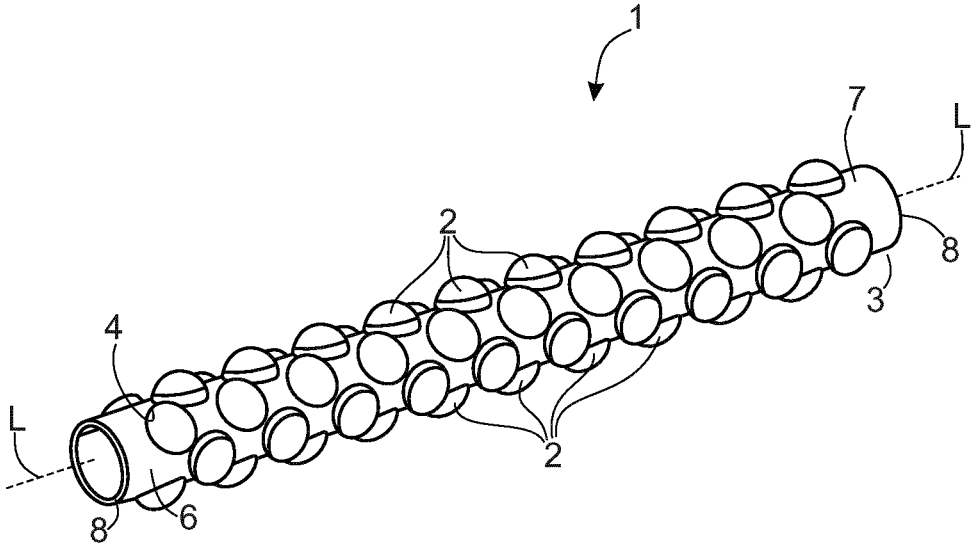
FIG. 1*b* depicts a perspective view of the holding device with hollow charges positioned therein according to an embodiment.

FIG. 1*b* shows a pipe 6 as a holding device 3 of a perforating gun 1 with encapsulated hollow charges 2 inserted in holes 4. By "encapsulated", what is meant is that the normally "open end" of the hollow charge 3, (the end comprising a liner), is enclosed as if in a capsule by a protective member. By "hydraulically sealed," what is meant is that it is configured so as to form a sealed assembly capable of blocking fluid up to 400 bar pressure.

Figure 1C:
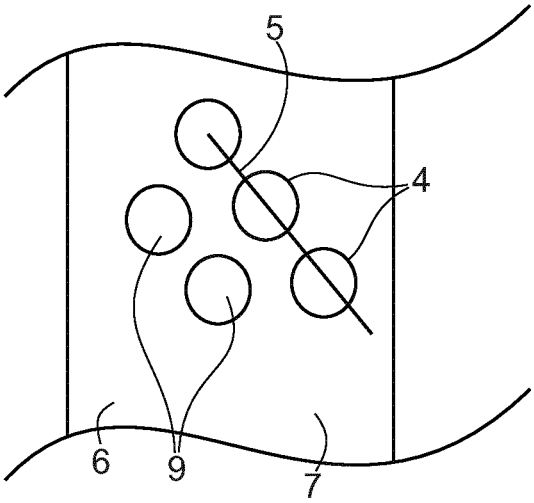
FIG. 1*c* depicts a cross-sectional view of an outer surface of a flattened section of the holding device according to an embodiment.
Figure 1D:
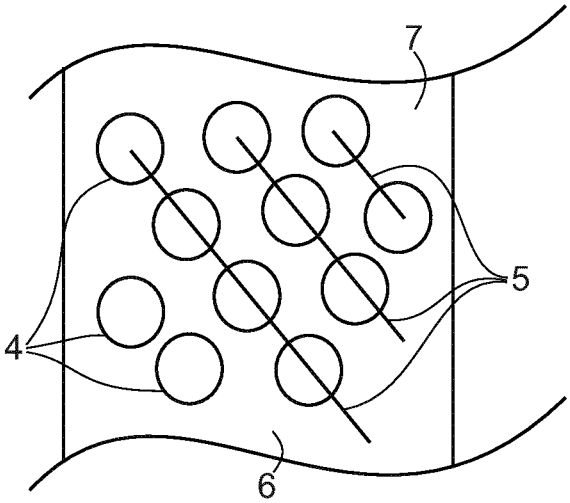
FIG. 1*d* depicts a cross-sectional view of a flattened section of the holding device according to an alternative embodiment.

If the perforating gun 1 is to be lowered into a wellbore without benefit of an outer housing or casing, (i.e., the system is an exposed system), there must be some mechanism for maintaining the charge or explosive formed along an inner wall of the hollow charge 2 in a sealed fashion such that no wellbore fluids, water, or the like, are capable of seeping into the hollow charge and thus rendering the charge incapable of discharging. An embodiment provides such a mechanism by encapsulating and hydraulically sealing the hollow charge. FIG. 1*a* shows a view of the end face of the perforating gun according to FIG. 1*b*. FIG. 1*c* shows a cutout of an outer surface or circumferential surface 7 of a pipe 6 with a single helix 5 on which the hollow charges 2 or on which the centers of the holes 4 are arranged, and FIG. 1*d* shows a flattened, cutout of the surface 7 with three parallel extending helices 5.

Figure 2:
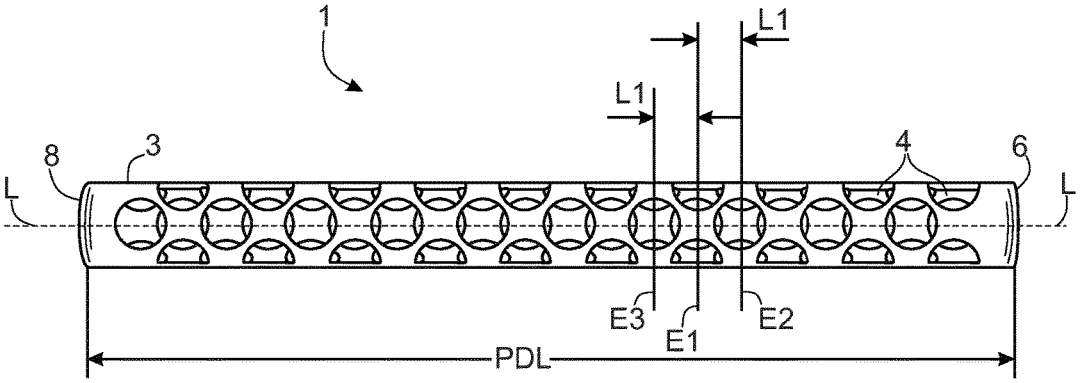
FIG. 2 depicts a side view of the holding device without hollow charges positioned therein according to an embodiment.

FIG. 2 shows the pipe 6 of FIG. 1 without inserted hollow charge 2.

Figure 3:
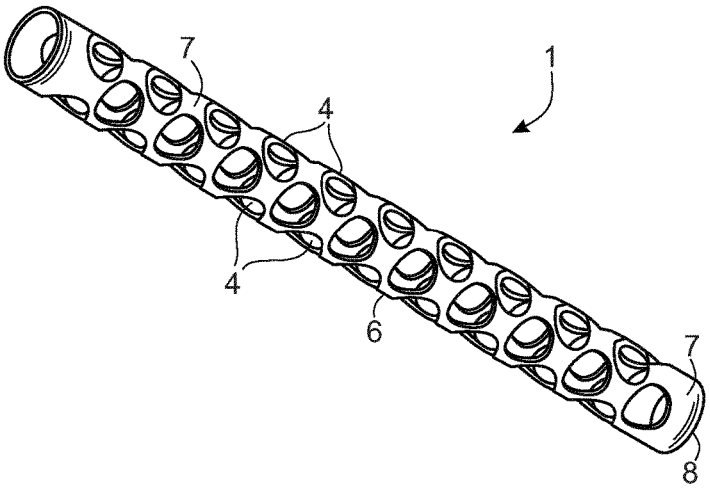
FIG. 3 depicts a perspective view of the holding device without hollow charges positioned therein according to an embodiment.

FIG. 3 shows the pipe 6 of FIGS. 1 and 2 in a perspective view.

Referring again to FIG. 1*b* and in an embodiment, the hollow charges 2 are mounted so tightly that they almost touch each other.

Referring again to FIG. 1*c*, additional holes 9 are inserted adjacent to helix 5, in an embodiment in a helix parallel to helix 5, for targeted weakening of the pipe 6. Exemplarily, only two of these additional holes 9 are shown in FIG. 1*c*. In an embodiment, the perforating gun 1 is self-supporting, and in another embodiment, the perforating gun 1 derives additional mechanical strength and rigidity from the hollow charges 3 themselves, once mounted within the holding device 3. Thus, the perforating gun 1 is configured with sufficient tensile and compressive strength to withstand load bearing for at least one perforating gun 1 without deformation or breakage, and in an embodiment, withstands load bearing for more than one perforating gun.

Referring again to FIG. 2 the reference numerals E1, E2, E3 denote individual planes that all extend perpendicular to the longitudinal axis L of the pipe 6 and parallel to each other. In each case, two adjacent planes are spaced apart from each other by the same distance L1. The holes 4 or the centers of the holes 4 are arranged on these planes. Considering a first level E1, the centers of the holes on adjacent planes E2 and E3 are each offset from the holes on the first plane in order to increase the number of hollow charges or the charge density.

Figure 4A:
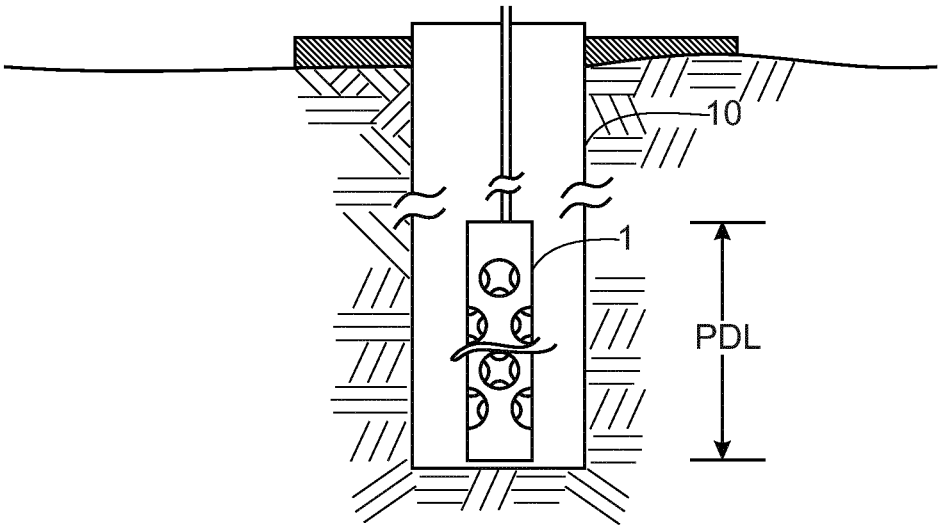
FIGS. 4*a* and 4*b* depict a cross-sectional view of the holding device lowered into a wellbore, both before and after detonation, according to an embodiment.
Figure 4B:
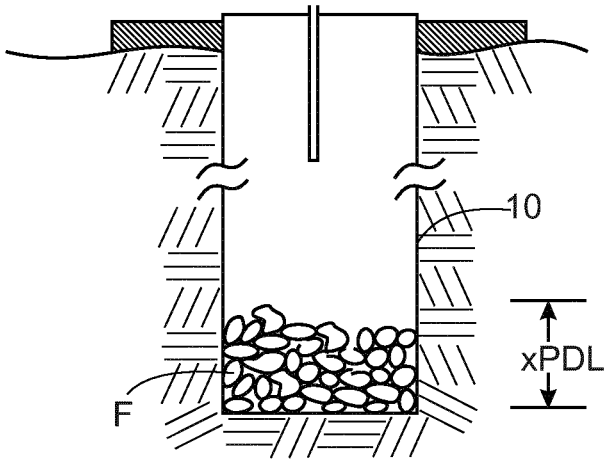

Referring to FIG. 4*a*, the perforating gun 1 assembled with the hollow charges 2 is lowered into a borehole 10. The perforating gun 1 or plurality of guns has a total pre-detonation length PDL. Upon detonation of the hollow charges 3, the perforating gun breaks down into fragments F. As shown in FIG. 4*b*, the fragments F are comprised of the remains of the perforating gun 1 that have broken apart into multiple small pieces and form a deposit in the bottom of the borehole. In an embodiment, the total height of the fragments remaining in the borehole is some percentage x of the total pre-detonation length PDL. In an embodiment, x amounts to about 10%-20%, and in a further embodiment about 10%-15% of a pre-detonation length PDL of the perforating gun 1. Thus, all of the components of the perforating gun 1 collapse into a small volume of debris upon detonation, meaning that the expense of withdrawing after discharging the perforating gun 1 is no longer necessary.

The invention claimed is:

1. A perforating gun system, comprising:

a plurality of hollow charges; and a holding device comprising a plurality of holes arranged along a helical path on a circumferential surface of the holding device, wherein the hollow charges are positioned within at least some of the plurality of holes, so that the perforating gun system comprises about 10 to 18 hollow charges per foot of length of the holding device, wherein at least a portion of the hollow charges extends beyond an outer surface of the holding device, wherein each of the hollow charges is encapsulated and hydraulically sealed so that the hollow charges are configured to withstand hydraulic pressures of at least 15,000 psi, and the hollow charges positioned within the holding device are operative for being directly exposed to fluid in a wellbore, the perforating gun is devoid of a secondary housing and the holding device has a wall thickness of from 2 mm to 8 mm so that the holding device withstands at least 1 ton of compression load along the length of the holding device and withstands the hydraulic pressures in the wellbore, and the perforating gun breaks up into fragmented debris upon detonation of the hollow charges and the fragmented debris remain in the wellbore.

2. The perforating gun system of claim 1, wherein the perforating gun further comprising a pre-detonation length, and wherein upon detonation of the hollow charges, the perforating gun breaks up into the fragmented debris comprising about 10%-20% of the pre-detonation length.

3. The perforating gun system of claim 2, wherein the perforating gun breaks up into the fragmented debris comprising about 10%-15% of the pre-detonation length.

4. The perforating gun system of claim 1, further wherein the holding device comprising at least one pipe or tube.

5. The perforating gun system of claim 1, further comprising:

at least one connecting element for connecting a plurality of the holding devices, wherein each of the holding devices is connected to an adjacent holding device via the connecting element such that a total length of the plurality of holding devices connected together is between about 15 to about 100 m.

6. The perforating gun system of claim 1, wherein the helical path comprises between about 1 to about 6 parallel extending helices.

7. The perforating gun system of claim 6, wherein about 3 to about 8 holes are arranged on each turn of the parallel extending helices.

8. The perforating gun system of claim 1, further comprising:

a plurality of recesses, grooves or additional holes without the hollow charges, positioned in the holding device between the holes.

9. The perforating gun system of claim 5, wherein the connecting element comprises a screw, a thread, a clip and/or a wedge.

10. The perforating gun system of claim 1, wherein the holding device has a length of between about 1 m and 6 m.

11. The perforating gun system of claim 1, wherein a center of each of the holes is arranged on a plane that is perpendicular to a longitudinal axis of the holding device and each center of each hole extends parallel to each other, and wherein two adjacent planes are arranged at an equal distance from one another.

12. The perforating gun system of claim 11, wherein an equal number of the holes or the centers of the holes are arranged on each of the planes, and the centers of the holes on one plane are offset from the centers of the holes on one or more adjacent planes in order to increase the number of hollow charges or a charge density.

13. The perforating gun system of claim 1, wherein the perforating gun comprises a material selected from the group comprising stainless steel, aluminium, casting steel and a plastic comprising epoxy resin.

14. The perforating gun system of claim 1, wherein the hollow charges are configured to withstand hydraulic pressures of at least 20,000 psi.

15. The perforating gun system of claim 1, wherein the hollow charges are configured to withstand hydraulic pressures of from about 15,000 psi to about 20,000 psi.

16. The perforating gun system of claim 1, wherein the holding device is configured to withstand up to 3 tons of tensile load along the length of holding device and at least 3 tons of compression load along the length of the holding device.

17. The perforating gun system of claim 1, wherein the fragmented debris has a height of from about 10% to about 20% of the length of the holding device prior to detonation.

18. The perforating gun system of claim 1, wherein the plurality of holes are arranged in a triple helical arrangement.

19. The perforating gun system of claim 8, wherein each of the plurality of holes and the plurality of additional holes without the hollow charges comprises a diameter that corresponds to an outer diameter of the encapsulated and hydraulically sealed hollow charges.

20. The perforating gun system of claim 1, wherein each of the hollow charges comprise an open end, and the open end is closed by a dome-shaped protective member.

* * * * *